US006105208A

United States Patent [19]

Westerdale et al.

[11] Patent Number: 6,105,208

[45] Date of Patent: Aug. 22, 2000

[54] VEHICLE DOOR CHECK

[75] Inventors: David L. Westerdale, Monroe; Graham J. Britain, Walled Lake, both of Mich.

[73] Assignee: Midway Products Group, Inc., Monroe, Mich.

[21] Appl. No.: 09/300,023

[22] Filed: Apr. 27, 1999

[51] Int. Cl.[7] ..... E05D 11/10; E05F 5/06

[52] U.S. Cl. ..... 16/334; 16/336; 16/85; 16/86 C; 16/357; 16/82; 292/265

[58] Field of Search ..... 16/334, 333, 335, 16/336, 344, 348, 357, 82, 86 B, 86 C, 85; 292/262, 265, 266, 275, DIG. 17

[56] References Cited

U.S. PATENT DOCUMENTS

| | | | |
|---|---|---|---|
| 1,918,652 | 7/1933 | Marbach . | |
| 2,131,339 | 9/1938 | Valletta . | |
| 2,232,986 | 2/1941 | Westrope . | |
| 2,268,976 | 1/1942 | Westrope . | |
| 2,291,412 | 7/1942 | Schonitzer . | |
| 2,523,088 | 9/1950 | Beyer . | |
| 2,677,851 | 5/1954 | Beyer . | |
| 2,712,149 | 7/1955 | Harms | 16/336 |
| 2,915,779 | 12/1959 | Allen . | |
| 2,917,770 | 12/1959 | Etnyre . | |
| 2,934,783 | 5/1960 | Johnson . | |
| 2,939,166 | 6/1960 | Allen . | |
| 3,905,064 | 9/1975 | Brockhaus . | |
| 4,090,273 | 5/1978 | Hurst, Jr. . | |
| 4,353,146 | 10/1982 | Brockhaus . | |
| 4,446,596 | 5/1984 | Arlauskas . | |
| 4,528,718 | 7/1985 | Brockhaus . | |
| 4,536,918 | 8/1985 | Brockhaus . | |
| 4,619,016 | 10/1986 | Brockhaus . | |
| 4,628,567 | 12/1986 | Brockhaus et al. . | |
| 4,672,715 | 6/1987 | Beckwith . | |
| 4,675,940 | 6/1987 | Brockhaus . | |
| 4,800,623 | 1/1989 | Brockhaus . | |
| 4,833,755 | 5/1989 | Bonin | 16/344 |
| 4,854,009 | 8/1989 | Brockhaus . | |
| 4,858,952 | 8/1989 | Sasaki et al. | 292/265 |
| 4,864,689 | 9/1989 | Brockhaus . | |
| 4,879,785 | 11/1989 | Tölle et al. . | |
| 4,932,100 | 6/1990 | Flowers et al. . | |
| 4,979,263 | 12/1990 | Tölle . | |
| 4,997,221 | 3/1991 | Tölle et al. . | |
| 5,026,103 | 6/1991 | Tölle et al. . | |
| 5,039,144 | 8/1991 | Tölle . | |
| 5,074,010 | 12/1991 | Gignac et al. . | |
| 5,112,091 | 5/1992 | Klüting . | |
| 5,173,991 | 12/1992 | Carswell . | |
| 5,205,016 | 4/1993 | Kulot et al. . | |
| 5,247,850 | 9/1993 | Lenzke . | |
| 5,272,935 | 12/1993 | Heinemann et al. . | |
| 5,291,634 | 3/1994 | Zanetti . | |
| 5,410,777 | 5/1995 | Gruber . | |
| 5,474,344 | 12/1995 | Lee . | |
| 5,501,421 | 3/1996 | Klüting . | |
| 5,575,037 | 11/1996 | Tolle et al. . | |
| 5,586,361 | 12/1996 | Tölle et al. . | |
| 5,624,150 | 4/1997 | Venier . | |
| 5,632,065 | 5/1997 | Siladke et al. | 16/335 |
| 5,671,966 | 9/1997 | Busch . | |
| 5,675,869 | 10/1997 | Lotz . | |
| 5,706,556 | 1/1998 | Klüting . | |
| 5,727,287 | 3/1998 | Hosken et al. . | |

FOREIGN PATENT DOCUMENTS

| | | |
|---|---|---|
| 24 15 887 | 10/1975 | Germany . |

*Primary Examiner*—Chuck Y. Mah
*Attorney, Agent, or Firm*—Brooks & Kushman P.C.

[57] ABSTRACT

A vehicle body door check (10) includes a scissors assembly (20) and a keeper (48) received between a pair of elongated check arms (22,24) of the scissors assembly and operable under the bias of a spring (46) to hold an associated vehicle door in an open position upon engagement with a check formation (36).

18 Claims, 3 Drawing Sheets

VEHICLE DOOR CHECK

TECHNICAL FIELD

This invention relates to a vehicle door check for holding a vehicle door in an open position with respect to an associated vehicle body.

BACKGROUND ART

Vehicle door checks are utilized to hold vehicle doors in an open position with respect to an associated vehicle body so as to facilitate driver and passenger ingress and egress. Prior patents that were noted by an investigation conducted in connection with the present invention are disclosed by U.S. Pat. No. 1,918,652 Marbach; U.S. Pat. No. 2,131,339 Valletta; U.S. Pat. No. 2,232,986 Westrope; U.S. Pat. No. 2,268,976 Westrope; U.S. Pat. No. 2,291,412 Schonitzer; U.S. Pat. No. 2,523,088 Beyer; U.S. Pat. No. 2,677,851 Beyer; U.S. Pat. No. 2,915,779 Allen; U.S. Pat. No. 2,917,770 Etnyre; U.S. Pat. No. 2,934,783 Johnson; U.S. Pat. No. 2,939,166 Allen; U.S. Pat. No. 3,905,064 Brockhaus; U.S. Pat. No. 4,090,273 Hurst, Jr.; U.S. Pat. No. 4,353,146 Brockhaus; U.S. Pat. No. 4,446,596 Arlauskas; U.S. Pat. No. 4,528,718 Brockhaus; U.S. Pat. No. 4,536,918 Brockhaus; U.S. Pat. No. 4,619,016 Brockhaus; U.S. Pat. No. 4,628,567 Brockhaus et al.; U.S. Pat. No. 4,672,715 Beckwith; U.S. Pat. No. 4,675,940 Brockhaus; U.S. Pat. No. 4,800,623 Brockhaus; U.S. Pat. No. 4,997,221 Tölle et al.; U.S. Pat. No. 5,026,103 Tölle et al.; U.S. Pat. No. 5,112,091 Klüting; U.S. Pat. No. 4,854,009 Brockhaus; U.S. Pat. No. 4,864,689 Brockhaus; U.S. Pat. No. 4,879,785 Tölle et al.; U.S. Pat. No. 4,932,100 Flowers et al.; U.S. Pat. No. 4,979,263 Tölle; U.S. Pat. No. 5,039,144 Tölle; U.S. Pat. No. 5,074,010 Gignac et al.; U.S. Pat. No. 5,173,991 Carswell; U.S. Pat. No. 5,205,016 Kulot et al.; U.S. Pat. No. 5,247,850 Lenzke; U.S. Pat. No. 5,272,935 Heinemann et al.; U.S. Pat. No. 5,291,634 Zanetti; U.S. Pat. No. 5,410,777 Gruber; U.S. Pat. No. 5,474,344 Lee; U.S. Pat. No. 5,501,421 Klüting; U.S. Pat. No. 5,575,037 Tölle et al.; U.S. Pat. No. 5,586,361 Tölle et al.; U.S. Pat. No. 5,624,150 Venier; U.S. Pat. No. 5,671,966 Busch; U.S. Pat. No. 5,727,287 Hosken et al.; U.S. Pat. No. 5,675,869 Lotz; and U.S. Pat. No. 5,706,556 Klüting; and also by German Offenlegungsschrift 24 15 887.

DISCLOSURE OF INVENTION

An object of the present invention is to provide an improved vehicle door check for holding a vehicle door in an open position with respect to an associated vehicle body door opening.

In carrying out the above object, the improved vehicle door check is constructed for mounting between a vehicle body portion and a portion of a vehicle door to hold the door in an open position. The door check includes a scissors assembly including a pair of elongated check arms each of which has opposite ends and an intermediate portion extending therebetween. Each of the check arms has an elongated contact surface that opposes the elongated contact surface of the other check arm, and at least one of the contact surfaces has a check formation. A pivotal connection pivotally connects a first pair of ends of the check arms to each other and also includes a connector for providing connection thereof to one of the vehicle body and door portions. A spring extends between a second pair of ends of the check arms to bias the elongated contact surfaces thereof toward each other. A keeper of the door check is mounted by the other one of the vehicle body and door portions and is located between the pair of elongated check arms so as to be engaged by the contact surfaces thereof under the bias of the spring to hold the door in the open position upon engagement thereof with the check formation.

In the preferred construction of the vehicle door check, the check formation has a configuration for providing an almost fully open position and a fully open position. In addition, at least one of the contact surfaces has another check formation for holding the door in a partially open position.

The preferred construction of the vehicle door check has both of the elongated contact surfaces on the pair of elongated check arms provided with check formations for engaging the keeper to hold the door in the open position. These check formations have configurations for engaging the keeper to hold the door in the almost fully open position and the fully open position. Both of the elongated contact surfaces on the pair of elongated check arms also have another check formation for engaging the keeper to hold the door in the partially open position.

In the preferred construction, the connector of the pivotal connection of the vehicle door check has a surface for mounting on the vehicle body portion, and the keeper has a surface for mounting thereof on the door portion.

The preferred construction of the keeper of the vehicle door check includes at least one roller that rolls between the elongated check arms of the scissors assembly. Preferably, there are a plurality of rollers that rollingly move along the contact surfaces of the pair of elongated check arms. Also, the spring of the vehicle door check is preferably a helical spring having opposite ends. One of the elongated check arms has an extension that extends through the helical spring and has a distal end including a seat for seating one end of the helical spring. The other elongated check arm has a seat that seats the other end of the helical spring.

In the preferred construction of the scissors assembly, one of the pair of elongated check arms includes a single elongated check arm member that extends between the pivotal connection and the spring. The other elongated check arm includes a pair of elongated check arm members that extend between the pivotal connection and the spring with the single elongated check arm member therebetween. The spring as mentioned above is a helical spring having opposite ends, and the single elongated check arm member is the one having an extension that extends through the helical spring and includes a distal end having a seat for seating the one end of the helical spring. The pair of elongated check members have seat surfaces that provide the seat for seating the other end of the helical spring. In addition, the keeper includes a central roller that rolls against the single elongated check arm member, and the keeper also includes a pair of spaced rollers located on opposite sides of the central roller to roll against the pair of elongated check arm members.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
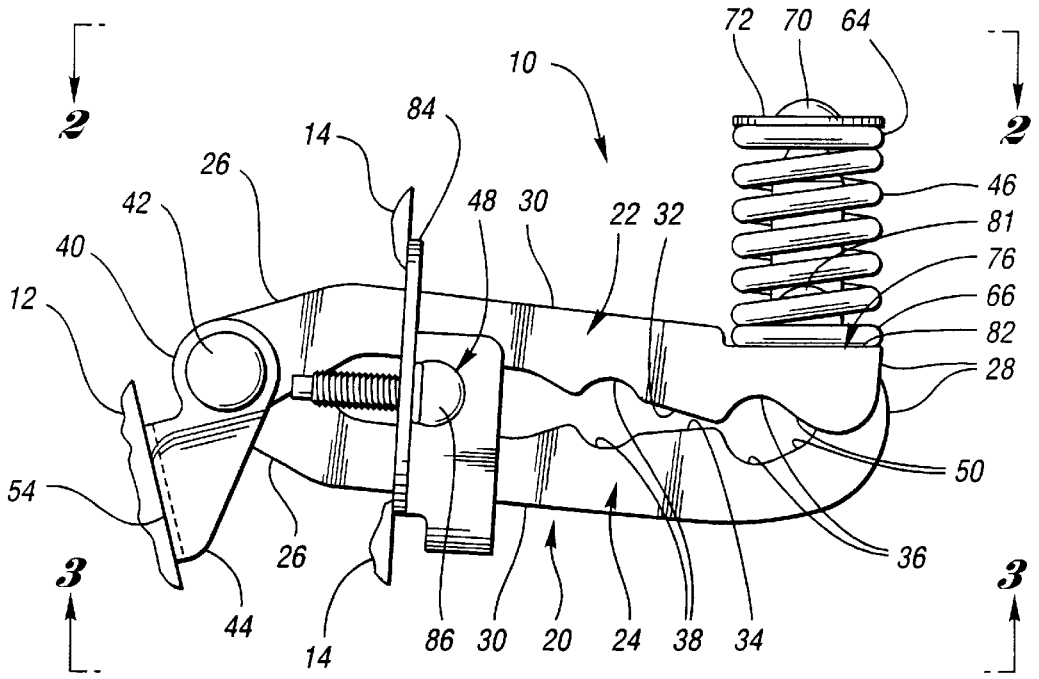
FIG. 1 is a plan view of a vehicle door check constructed in accordance with the invention.
Figure 2:
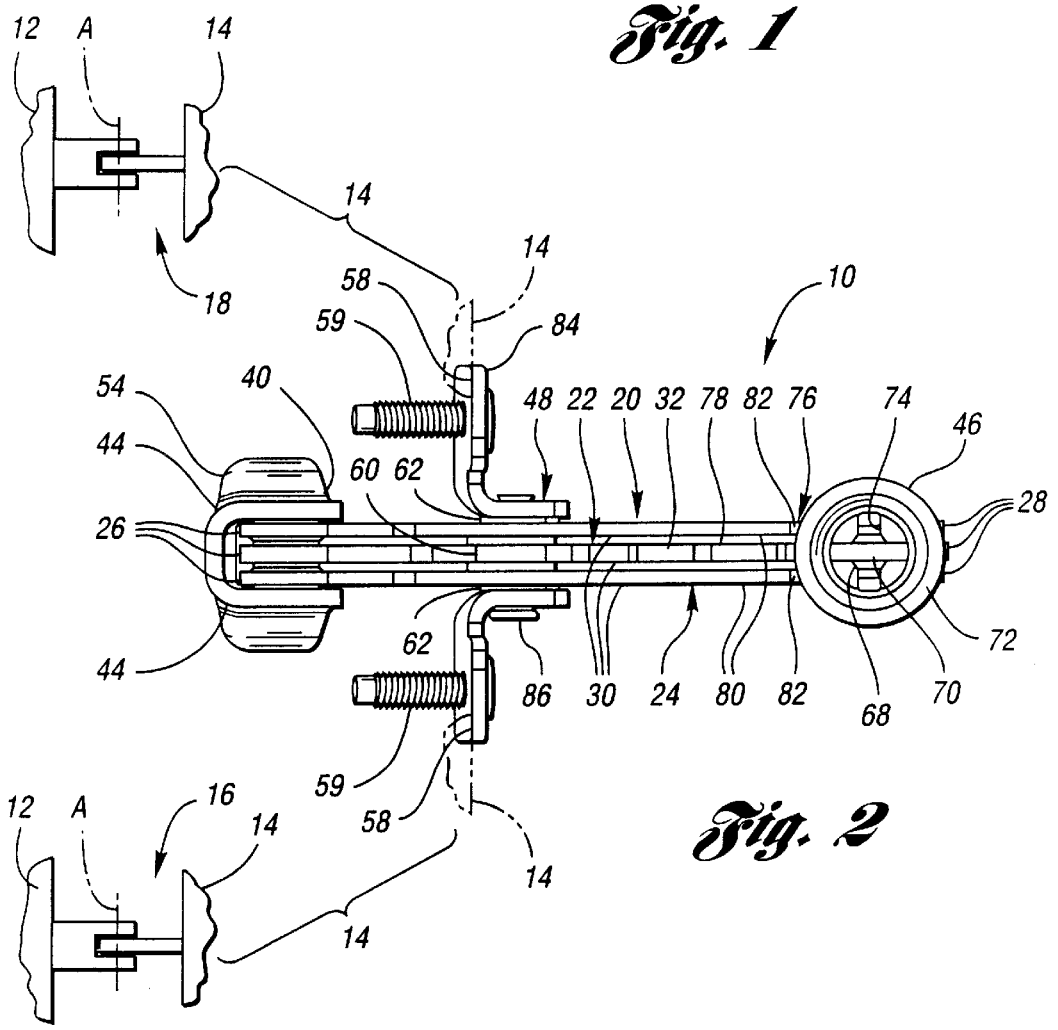
FIG. 2 is a elevational view taken along the direction of line 2—2 in FIG. 1 and also schematically illustrates the vehicle door hinges which are located above and below the door check.
Figure 4:
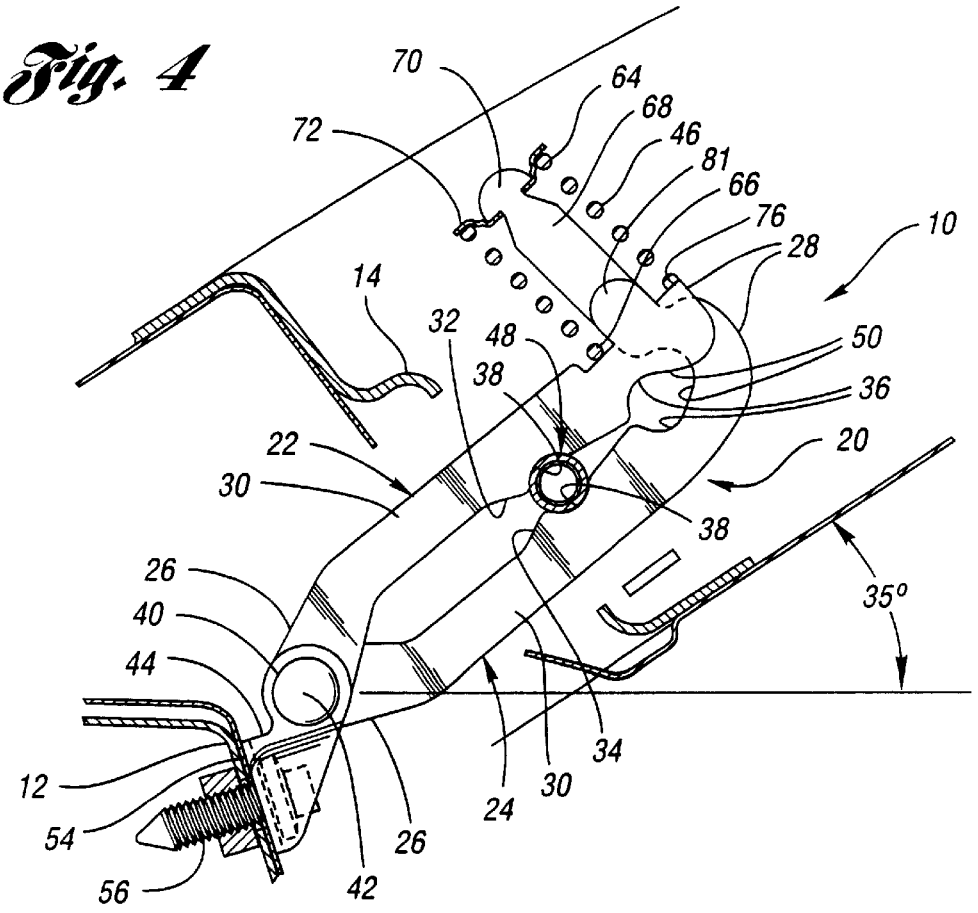
FIG. 4 is a plan view similar to FIG. 1 but showing the door check in a partial open Position of the associated vehicle door.
Figure 5:
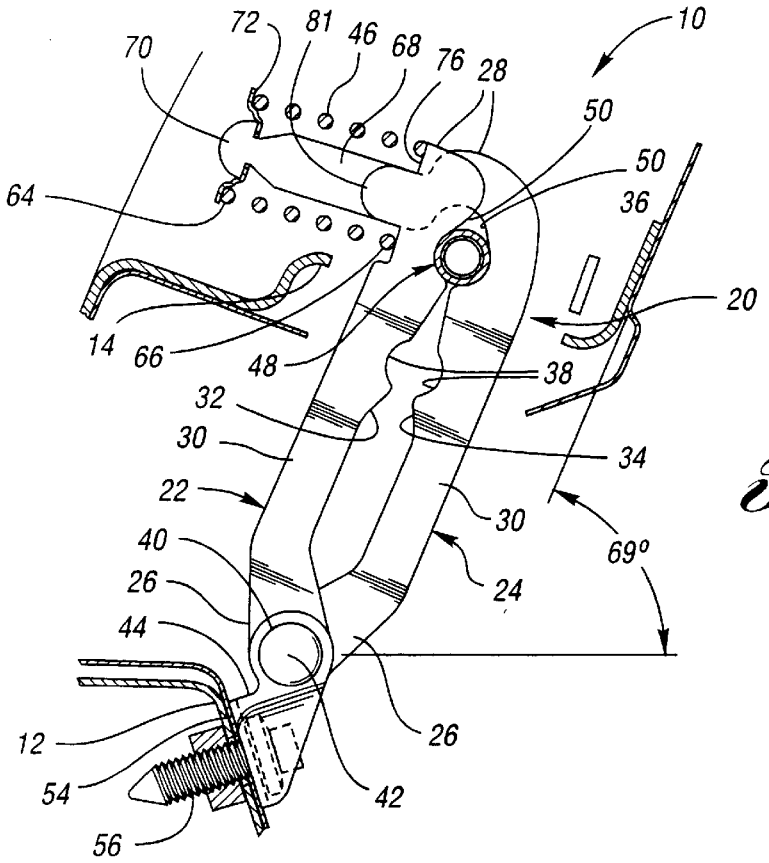
FIG. 5 is a view similar to FIG. 4 but illustrating the door check with the vehicle door in an open position that is actually an almost fully open position.
Figure 6:
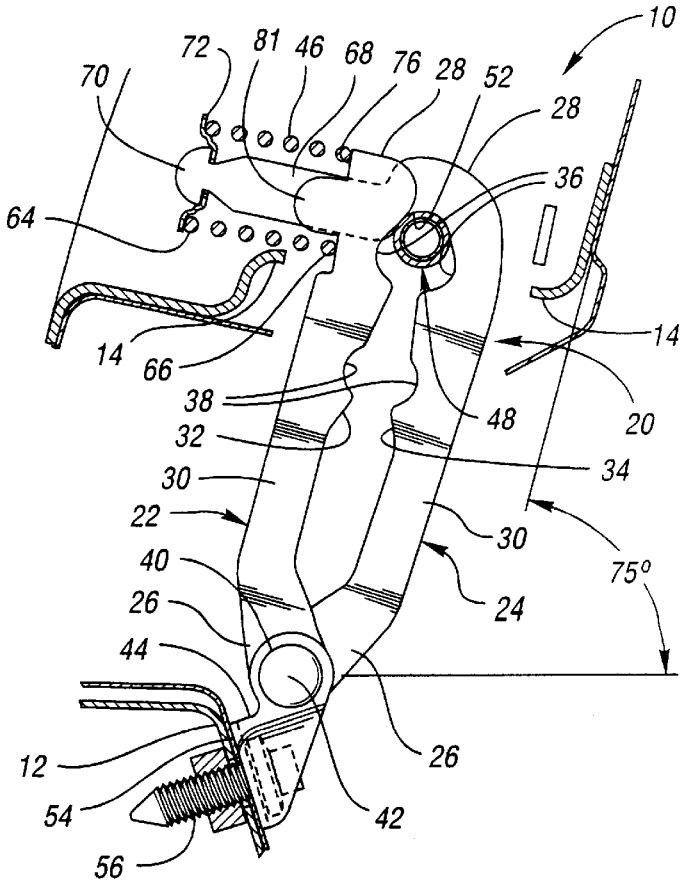
FIG. 6 is a view similar to FIG. 5 illustrating the door check in a fully open position.

With reference to FIGS. 1 and 2, a vehicle door check constructed in accordance with the invention is generally indicated by 10 and is utilized for mounting between a vehicle body portion 12 and a vehicle door portion 14 to hold the door in an open position as is hereinafter more fully described. As illustrated in FIG. 1, the door check 10 is positioned with the associated vehicle door in a closed position. This door check is mounted vertically intermediate lower and upper door hinges 16 and 18 which support the door for movement about a pivotal axis A for movement between the door closed position illustrated in FIG. 1, a partially open position illustrated in FIG. 4, and open positions illustrated in FIGS. 5 and 6, with FIG. 5 illustrating an almost fully open position and FIG. 6 illustrating a fully open position that are respectively referred to in the vehicle manufacturing industry as soft and hard open positions. The opening pivotal movement of the door will vary depending upon each particular application; however, the partially open position as illustrated in FIG. 4 will normally about 30–40° as exemplified by the 35° angle shown in FIG. 4, the soft open position of FIG. 5 will normally be about 65–72° as exemplified by the 69° angle shown in FIG. 5 and the hard open position will normally be about 72–78° as exemplified by the 75° angle shown in FIG. 6.

Figure 3:
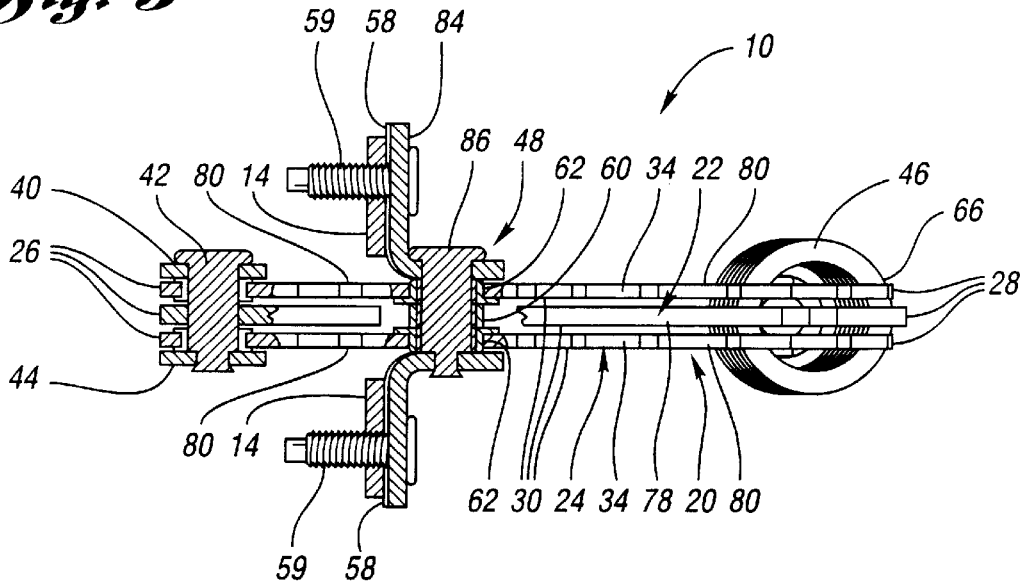
FIG. 3 is an elevational view of the door check taken along the direction of line 3—3 in FIG. 1 in an opposite direction as FIG. 2.

As illustrated in FIGS. 1–3, the door check 10 includes a scissors assembly 20 including a pair of elongated check arms 22 and 24. Each of the check arms has opposite ends 26 and 28 and an intermediate portion 30 extending between its ends. The check arms 22 and 24 have elongated contact surfaces 32 and 34 that oppose each other as best shown in FIG. 1. At least one of the contact surfaces 32 and 34, and actually both of them as illustrated in FIG. 1, has a check formation 36 that is operable to hold the associated vehicle door in the open position as illustrated by FIGS. 5 and 6 as is hereinafter more fully described. In addition, at least one of the contact surfaces 32 and 34, and actually each of them, has another check formation 38 for holding the door in the partial open position of FIG. 4 as is also hereinafter more fully described.

With continuing reference to FIGS. 1–3, the door check includes a pivotal connection 40 that pivotally connects a first pair of ends 26 of the check arms 22 and 24 to each other. More specifically, the pivotal connection 40 includes a pintle 42 that extends through holes in the check arm ends 26 and is supported by spaced portions of a connector 44 for providing connection thereof to one of the vehicle body and door portions 12 and 14, specifically the body portion 12 as illustrated.

As best illustrated in FIG. 1, a spring 46 extends between the second pair of ends 28 of the check arms 22 and 24 and, as is hereinafter more fully described, biases the elongated contact surfaces 32 and 34 thereof toward each other. A keeper of the door check is collectively indicated by 48 and is mounted by either the vehicle body or door portion 12 or 14, specifically the door portion 14 as illustrated, so that the door check extends between the vehicle body and the door. The keeper 48 as illustrated in FIGS. 4–6 is located between the pair of elongated check arms 22 and 24 so as to be engaged by the contact surfaces 32 and 34 thereof under the bias of the spring 46 so as to hold the door in the open position upon engagement with the check formation 36 as illustrated in FIGS. 5 and 6 and to also hold the door in the partial open position upon engagement with the check formation 38 as shown in FIG. 4. Upon movement back to the door close position, the keeper 48 moves to the left of the partially open check formation 38 as shown in FIG. 1.

As illustrated in FIG. 5, the door check 10 is positioned in the almost fully open position that is referred to in the industry as a soft open position. Toward the check arm ends 28 from the keeper 48 in this position, the check formations 36 have ramps 50 that cooperatively provide a pointed shape facing upwardly and toward the right such that further door opening movement is permitting as the keeper 48 moves to the position of FIG. 6 where it engages a hook-shaped surface 52 of the end 28 of check arm 24 and thereby prevents any further outward movement.

During the movement of the door between the closed position illustrated in FIG. 1, the partially open position illustrated in FIG. 4 and the open positions illustrated in FIGS. 5 and 6, the spring 46 resiliently compresses and extends as necessary while the keeper 48 moves along the elongated contact surfaces 32 and 34 of the check arms as they pivot with respect to each other about the pivotal connection 40 in a scissors-like manner to provide the door check function. As shown by combined reference to FIGS. 1 and 4–6, the pivotal connection 40 has its connector 44 provided with a surface 54 for mounting on the vehicle body portion 12 with securement being provided as shown in FIGS. 4–6 by a threaded screw 56. Likewise, the keeper 48 as best illustrated in FIGS. 2 and 3, has a surface 58 for mounting thereof on the door portion 14 such that the spring 46 is received within the door and moved internally thereof as the door is moved between its open and closed positions as previously described. Screws 59 secure the keeper surface 58 to the vehicle body portion 12. Keeper 48 includes at least one roller 60 and preferably includes a plurality of rollers 60 and 62. These rollers roll between the elongated check arms 22 and 24 of the door check in rolling movement along their elongated contact surfaces 32 and 34 as is hereinafter more fully described.

As illustrated in FIG. 1, the spring 46 is a helical spring having opposite ends 64 and 66. Check arm 22 includes an extension 68 that extends through the helical spring 46 and has a distal end 70 including a seat 72 for seating the one end 64 of the helical spring. More specifically, this seat 72 is a stamped disc as shown in FIG. 2 has a slot 74 through which the distal end 70 is inserted whereupon the seat is rotated 90° such that its distal end 70 captures the seat and under the bias of the helical spring 46 maintains the assembled relationship illustrated. The elongated check arm 24 includes a seat 76 that seats the other end 66 of the helical spring 46 as is hereinafter more fully described.

As illustrated in FIGS. 2 and 3, the one elongated check arm 22 includes a single elongated check arm member 78 that extends between the pivotal connection 40 and the helical spring 46, while the other elongated check arm 24 includes a pair of elongated check arm members 80 that extend between the pivotal connection 40 and the helical spring 46 with the single elongated check arm member 76 therebetween. More specifically, the single elongated check arm member 76 as shown in FIG. 1 includes the extension 68 that extends through the helical spring 46 to secure the seat 72 that seats the one spring end 64. The pair of elongated check arm members 80 have seat surfaces 82 that provide the seat 68 for seating the other end 66 of the helical spring 46 on opposite sides of the extension 68 of the single check arm member 78. The pair of elongated check arm members 80 also have projections 81 that are received within the helical spring end 66 as best shown in FIGS. 4–6 to properly align the spring.

As illustrated in FIGS. 2 and 3 and as previously described, the keeper 48 includes a central roll 60 that is rollingly engaged with the elongated contact surface on the single elongated check arm member 78 of the one check arm 22. In addition, the keeper 48 also includes the pair of spaced rollers 62 that are rollingly engaged with the pair of elongated contact surfaces of the pair of elongated check arm members 80 of the other check arm 24. A bracket 84 of the keeper supports a pin 86 on which the rollers 60 and 62 are rotatably supported, and this bracket also defines the surface 58 that is secured by the screws 59 to the door portion 14 that mounts the keeper.

While the best mode for carrying out the invention has been described in detail, those familiar with the art to which this invention relates will recognize various alternative designs and embodiments for practicing the invention as defined by the following claims.

What is claimed is:

1. A vehicle door check for mounting between a vehicle body portion and a portion of a vehicle door to hold the door in an open position, the door check comprising:

a scissors assembly including a pair of elongated check arms each of which has opposite ends and an intermediate portion extending therebetween, each of said check arms having an elongated contact surface that opposes the elongated contact surface of the other check arm, and at least one of the contact surfaces having a check formation;

a pivotal connection that pivotally connections a first pair of ends of the check arms to each other and that also includes a connector for providing connection thereof to one of the vehicle body and door portions;

a spring that extends between a second pair of ends of the check arms to bias the elongated contact surfaces thereof toward each other; and a keeper that is mounted by the other one of the vehicle body and door portions and that is located between the pair of elongated check arms so as to be engaged by the contact surfaces thereof under the bias of the spring and to hold the door in the open position upon engagement thereof with the check formation.

2. A vehicle door check as in claim 1 wherein the check formation has a configuration for providing an almost fully open position and a fully open position.

3. A vehicle door check as in claim 1 wherein at least one of the contact surfaces has another check formation for holding the door in a partially open position.

4. A vehicle door check as in claim 1 wherein the check formation has a configuration for providing an almost fully open position and a fully open position, and at least one of the contact surfaces having another check formation for holding the door in a partially open position.

5. A vehicle door check as in claim 1 wherein both of the elongated contact surfaces on the pair of elongated check arms have check formations for engaging the keeper to hold the door in the open position.

6. A vehicle door check as in claim 5 wherein the check formations have configurations for engaging the keeper to hold the door in an almost fully open position and a fully open position.

7. A vehicle door check as in claim 1 wherein both of the elongated contact surfaces on the pair of elongated check arms have another check formation for engaging the keeper to hold the door in a partially open position.

8. A vehicle door check as in claim 1 wherein both of the elongated contact surfaces on the pair of elongated check arms have check formations for engaging the keeper to hold the door in an almost fully open position and a fully open position, and both of the elongated contact surfaces on the pair of elongated check arms having another check formation for engaging the keeper to hold the door in a partially open position.

9. A vehicle door check as in claim 1 wherein the connector of the pivotal connection has a surface for mounting on the vehicle body portion, and the keeper having a surface for mounting thereof on the door portion.

10. A vehicle door check as in claim 1 wherein the keeper includes at least one roller that rolls between the elongated check arms of the scissors assembly.

11. A vehicle door check as in claim 1 wherein the keeper includes a plurality of rollers that rollingly move along the contact surfaces of the pair of elongated check arms.

12. A vehicle door check as in claim 1 wherein the spring is a helical spring having opposite ends, one of the elongated check arms having an extension that extends through the helical spring and has a distal end including a seat for seating one end of the helical spring, and the other elongated check arm having a seat that seats the other end of the helical spring.

13. A vehicle door check as in claim 1 wherein one of the pair of elongated check arms includes a single elongated check arm member that extends between the pivotal connection and the spring, and the other elongated check arm including a pair of elongated check arm members that extend between the pivotal connection and the spring with the single elongated check arm member therebetween.

14. A vehicle door check as in claim 13 the spring is a helical spring having opposite ends, the single elongated check arm member having an extension that extends through the helical spring and has a distal end including a seat for seating one end of the helical spring, and the pair of elongated check arm members having seat surfaces that provide a seat for seating the other end of the helical spring.

15. A vehicle door check as in claim 13 wherein the keeper includes a central roller that rolls against the single elongated check arm member, and the keeper also including a pair of spaced rollers located on opposite sides of the central roller to roll against the pair of elongated check arm members.

16. A vehicle door check as in claim 13 the spring is a helical spring having opposite ends, the single elongated check arm member having an extension that extends through the helical spring and has a distal end including a seat for seating one end of the helical spring, the pair of elongated check arm members having seat surfaces that provide a seat for seating the other end of the helical spring, the keeper including a central roller that rolls against the single elongated check arm member, and the keeper also including a pair of spaced rollers located on opposite sides of the central roller to roll against the pair of elongated check arm members.

17. A vehicle door check for mounting between a vehicle body portion and a portion of a vehicle door to hold the door in a partially open position and in an open position, the door check comprising:

a scissors assembly including a pair of elongated check arms each of which has opposite ends and an intermediate portion extending therebetween, each of said check arms having an elongated contact surface that opposes the elongated contact surface of the other check arm, and each of the contact surfaces having a partial open check formation and a door open check formation;

a pivotal connection that pivotally connections a first pair of ends of the check arms to each other and that also includes a connector for providing connection thereof to the vehicle body portion;

a helical spring that extends between a second pair of ends of the check arms to bias the elongated contact surfaces thereof toward each other; and a keeper that is mounted by the door portion and that includes rollers located between the pair of elongated check arms so as to roll against the contact surfaces thereof under the bias of the helical spring and to hold the door in the partially open position upon engagement thereof with the partial open check formation and to hold the door in the open position upon engagement with the door open check formation.

18. A vehicle door check for mounting between a vehicle body portion and a portion of a vehicle door to hold the door in a partially open position and in an open position, the door check comprising:

a scissors assembly including a pair of elongated check arms each of which has opposite ends and an intermediate portion extending therebetween, one of the check arms including a single check arm member, the other check arm including a pair of check arm members that are spaced from each other with the single check arm member therebetween, each of said check arm members having an elongated contact surface that opposes the other check arm, and each of the contact surfaces having a partial open check formation and a door open check formation;

a pivotal connection that pivotally connections a first pair of ends of the check arms to each other and that also includes a connector for providing connection thereof to the vehicle body portion;

a helical spring that extends between a second pair of ends of the check arms to bias the elongated contact surfaces thereof toward each other; and a keeper that is mounted by the door portion and that includes a central roller that rolls against the contact surface of the single check arm member, the keeper also including a pair of spaced rollers located on opposite sides of the central roller to roll against the contact surfaces of the pair of check arm members, and the rollers holding the door in the partially open position upon engagement with the partial open check formations of the contact surfaces and holding the door in the open position upon engagement with the door open check formations of the contact surfaces.

* * * * *